US005557850A

United States Patent [19]

Mun

[11] Patent Number: 5,557,850

[45] Date of Patent: Sep. 24, 1996

[54] RECIPROCAL ELECTRIC SHAVER

[75] Inventor: Kug H. Mun, Suwon, Rep. of Korea

[73] Assignee: Samsung Electronics Co., Ltd., Suwon, Rep. of Korea

[21] Appl. No.: 365,955

[22] Filed: Dec. 29, 1994

[30] Foreign Application Priority Data

Dec. 29, 1993 [KR] Rep. of Korea ..... 1993-30420

[51] Int. Cl.[6] ..... B26B 19/02

[52] U.S. Cl. ..... 30/43.92; 30/43.91

[58] Field of Search ..... 30/43.91, 43.92, 30/43.7, 43.8, 43.9

[56] References Cited

U.S. PATENT DOCUMENTS 2,334,994 11/1943 Dalkowitz ..... 30/43.91
2,590,452 3/1952 Peterson ..... 30/43.91
3,365,796 1/1968 Tolmie et al. ..... 30/43.92
5,207,731 5/1993 Buloschek ..... 30/43.92
5,231,760 8/1993 Koster et al. ..... 30/43.92 X

*Primary Examiner*—Hwei-Siu Payer
*Attorney, Agent, or Firm*—Burns, Doane, Swecker & Mathis, L.L.P.

[57] ABSTRACT

A reciprocal electric shaver includes a pair of cutters which are reciprocated in mutually opposite directions by a drive mechanism. The drive mechanism includes a motor and a drive gear affixed to an output shaft of the motor. A pair of driven gears are mounted for rotation about axes spaced from the drive shaft. The driven gears mesh with the drive gear. Connecting links connect each driven gear with a cutter. Each connecting gear is mounted eccentrically to its respective driven gear. The axis of the drive shaft is located midway between the center lines of the cutters, and the axes of the driven shafts intersect respective ones of those center lines.

6 Claims, 5 Drawing Sheets

RECIPROCAL ELECTRIC SHAVER

BACKGROUND OF THE INVENTION

The invention is related to a reciprocal electric shaving apparatus, and in particular, to a drive mechanism for the cutting heads.

PRIOR ART

A conventional reciprocal electric shaver is disclosed in Japan Laid-Open Patent Publication No. 92-220284 in which two head portions are each provided with a cutter blade arranged in parallel thereto, the two movable cutter blades reciprocated in a reverse direction relation to each other. The publication indicates the decreasing of the vibrations in the reciprocating movement directions of the two movable cutter blades and in the direction perpendicular to the reciprocating movement direction.

Referring to FIG. 1, a reciprocal electric shaver is constructed to enable vibrators 5 and 5*a* to be freely reciprocated by elastic pieces 6 fixed to both ends thereof and cam shafts 3 fixed to respective eccentric cams 2 and 2*a* to be cooperate with the vibrators 5 and 5*a*. Both of the eccentric cams 2 and 2*a* are mounted on the shaft 8 of a driving motor 1, and carry cam shafts 3 respectively mounted to link connecting portions 7 by connecting links 4. Thus, the rotation of the driving motor 1 is converted into the reciprocating movement of the vibrators 5 and 5*a* through the eccentric cams 2 and 2*a*, and the inner cutter blades coupled with the vibrators 5 and 5*a* are reciprocated to make it possible to shave off user's beard.

The two eccentric cams 2 and 2A have the same rotation center point and there is a gap of height k between the cams 2 and 2*a*. Since both of the cams 2, 2*a* are mounted on the motor shaft 8, a relatively large vertical load is applied to the motor shaft 8 and generates vibration when the driving motor 1 is rotated. Also, as shown in FIG. 2, the link connecting portions 7 of the vibrators 5 and 5*a* are positioned in parallel to each other and lie on the axis line X of the driving motor 1. The vibrators 5 and 5*a* are reciprocated along the center lines X1 and X2 thereof. The distance between lines X and $X_1$ is larger than the distance between lines X and $X_2$, and the load applied to the rotation shaft 8 of the driving motor 1 becomes larger, thereby generating a vibration in the direction perpendicular to the reciprocating direction.

In order to resolve these problems, an objective of the invention is to provide a reciprocal electric shaver comprising an improved configuration to minimize the vertical load applied to the rotation axis of a driving motor.

Another objective of this invention is to provide a reciprocal electric shaver comprising an improved configuration to prevent the generation of vibrations in the reciprocating directions of a vibrating member and in the direction perpendicular thereto.

Accordingly, the invention comprises at least one vibrating member including an elastic piece fixed to both ends thereof to be freely reciprocated; connecting links coupled with each of the elastic pieces of the vibrating member to be reciprocated; a motive force or drive gear coupled to the shaft of a driving motor and at least one follower or driven gear cooperating with the rotation of the motive force gear; and eccentric shafts mounted on the follower gears to be coupled to the connecting links, in which the rotation centers of the follower gears are positioned on a line coinciding with the reciprocating direction of the vibrating member to be symmetrical with the rotation center of the driving motor, thereby minimizing the vertical load applied to the rotation axis of a driving motor and also preventing the generation of the vibrations in the reciprocating directions of a vibrating member and the direction perpendicular thereto.

BRIEF DESCRIPTION OF THE DRAWINGS

The invention now will be described in detail with reference to the accompanying drawings, in which:

FIGS. 5A and 5B are transverse cross-sectional views illustrating the assembly of the reciprocal electric shaver according to the invention, in which FIG. 5A is a view illustrating the state in which an elastic member is arranged before the operation of the reciprocal electric shaver, and FIG. 5B is a view illustrating the state that the elastic member is reciprocated in the left and right directions; and, FIGS. 6A, 6B, 6C and 6D are views illustrating the positions that the vibrators are operated in opposite directions to each other.

DETAILED DESCRIPTION OF THE PREFERRED EMBODIMENT OF THE INVENTION

Figure 4:
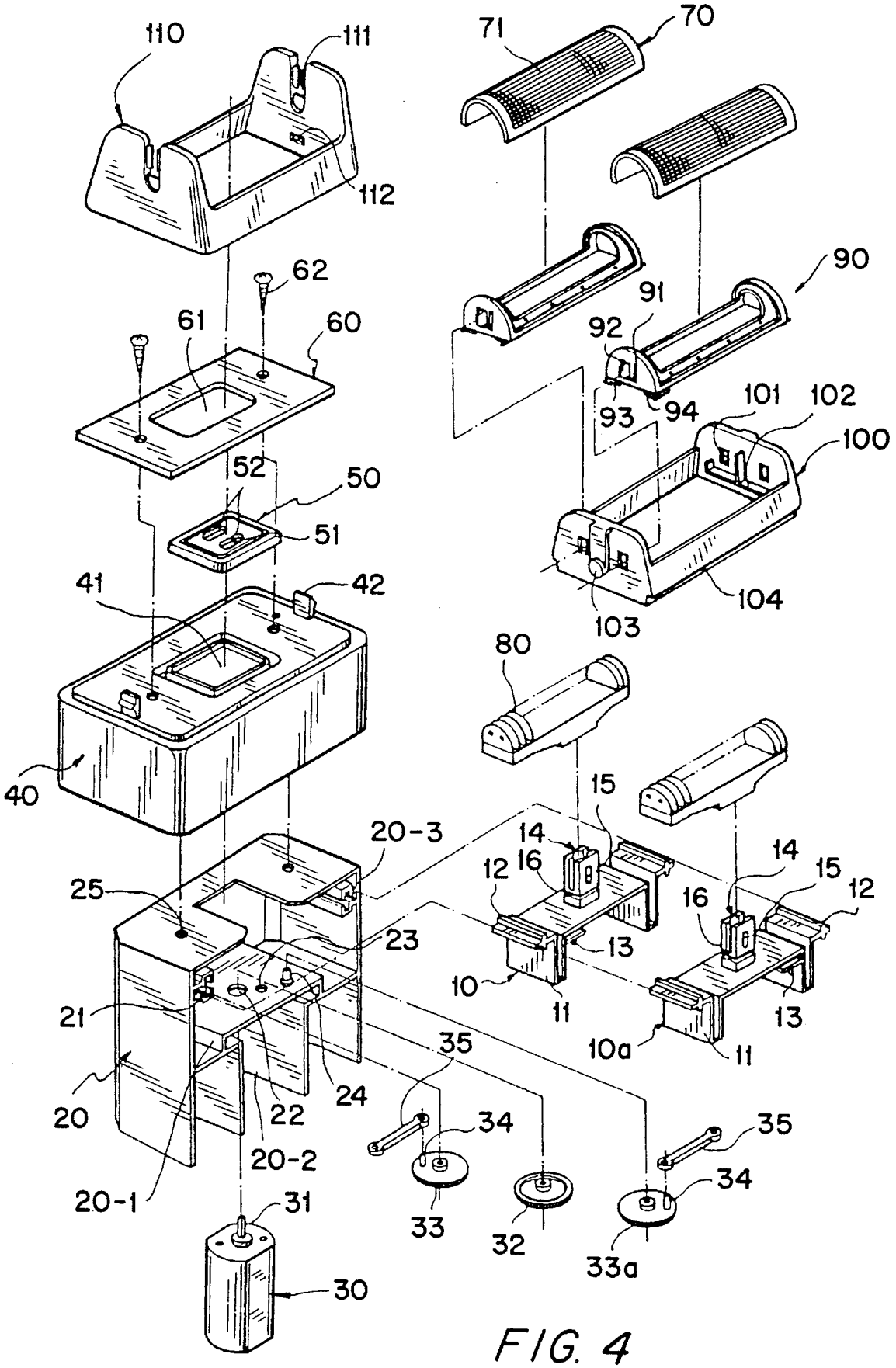
FIG. 4 is an exploded perspective view illustrating the assembly of the reciprocal electric shaver according to the invention.
Figure 5A:
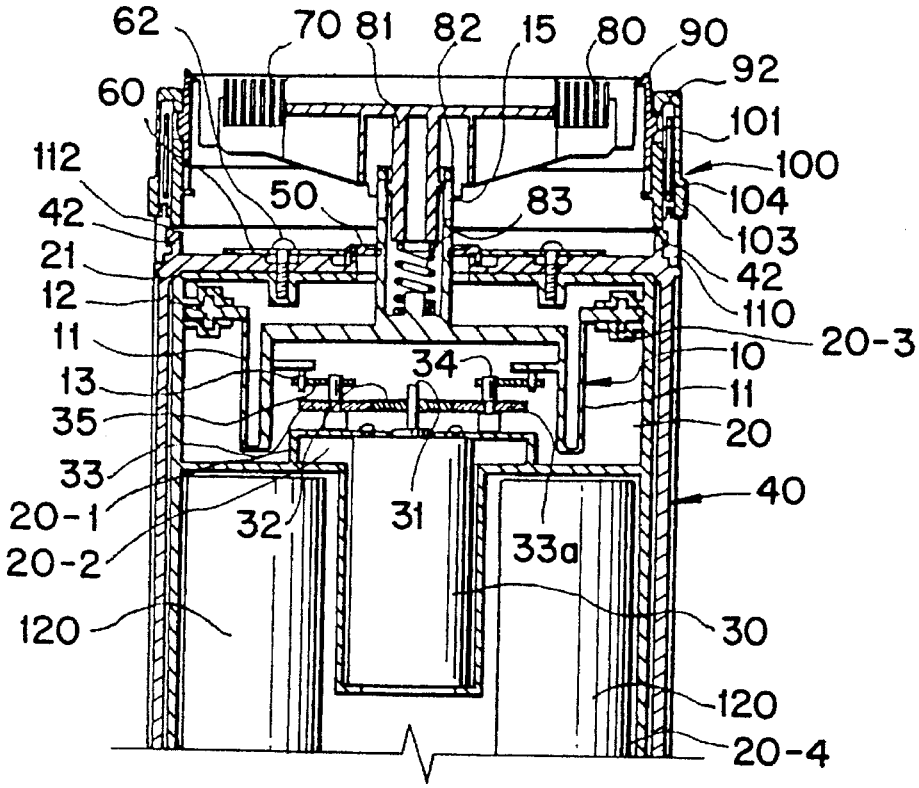
Figure 5B:
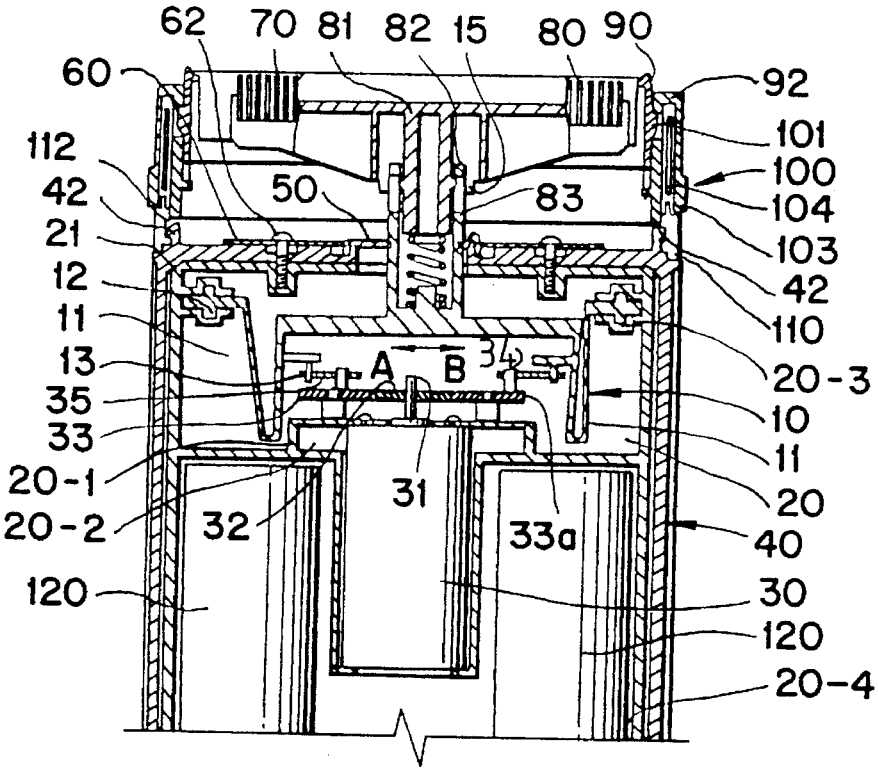

FIG. 4 and FIG. 5A, 5B are views illustrating the preferred embodiment of the invention. Vibrators or reciprocable members 10 and 10*a* include elastic pieces 11 fixed to both ends thereof to be freely reciprocated. The elastic piece 11 includes a portion extended outwardly from the upper end thereof, on the upper and lower surface of which a pair of projections 12 are formed which extend respectively upward and downward. An auxiliary case 20 includes guide rails 20-3 properly attached to the left and right inner side walls thereof. An elongated groove 21 is formed in the guide rail 20-3 to receive a projection 12 therein. Also, the auxiliary case 20 is provided with an intermediate wall 20-1 in which a through hole 22 and fixing holes 23 are formed to receive a shaft 31 of a driving motor 30 as well as to fix the driving motor 30 in a vertical arrangement by means of screws (not shown) to the middle of wall 20-1. The driving motor shaft 31 is coupled with a motive force gear or drive gear 32. The motive force gear 32 is engaged with follower gears or driven gears 33 and 33*a* which are fixed to respective shafts 24 disposed on the intermediate wall 20-1, in which the shafts 24 are arranged on a diagonal line intersecting the through hole 22. Both follower gears 33 and 33*a* are provided with an eccentric shaft 34 protruding from the upper surface thereof. The shafts 34 define secondary axes. Both eccentric shafts 34 are connected to connecting shafts 13 projected from the lower surface of the upper walls of the vibrators 10 and 10*a* by means of connecting links 35.

The auxiliary case 20 is inserted into a main body 40 so that head portions 14 of the vibrators 10 and 10*a* are projected upward through an opening 41 formed in the upper center of the main body 40, wherein the main body 40 includes hook members 42 integral with respective sides of the upper surface. Then, in order to prevent foreign materials from entering the main body 40, a packing member 50 made of rubber is assembled into the opening 41 so that each of the head portions 14 passes through openings 51 and 52 of the packing member 50 to hook its hanging groove 16 on the inner wall of the packing member 50. A pressing member 60 is fixed on the upper surface of the main body 40 by means of coupling screws 62 (which are secured in holes 25 formed in the auxiliary case 20) to press against the edge portion of the packing member 50. The head portions 14 are passed through an opening 61 in the member 60.

On the other hand, the head portion 14 includes two side walls separated from each other. An elongated hole 15 is formed on each of the side walls of the head portion 14. An inner cutter blade structure 80 is provided with a cylindrical portion 81 integrally extended from the lower surface thereof, on both surfaces of which ball-shaped projectors 82 are formed (see FIG. 5A). Thus, the cylindrical portion 81 is moved upward by the elastic force of a coil spring 83 disposed in the head portion 14 with the ball-shaped projectors 82 sliding in the elongated holes 15, enabling the inner cutter blade structure 80 to move upward and downward.

Shave units 70 having a plurality of apertures 71 are mounted on the upper portion of respective shave unit frames 90 with its lower edges being heat-melted. The shave unit frame 90 is provided with elastic side walls 91 each having a projection 92 and elastic members 93. Each of members 93 has a contacting projection 94 to support its frame as described below in detail. A shave unit supporter 100 is provided with a pair of elongated holes 101 and supporting ribs 102 which are formed on each of the inner side walls thereof. Therefore, the shave unit frames 90 are assembled into the shave unit supporter 100, in a manner that the two projections 92 of each frame 90 are respectively fitted into two of the elongated holes 101, while the contacting projections 94 make contact with the upper surface of the supporting ribs 102 to position the shave unit frames 90 in the shave unit supporter 100.

Also, the shave unit supporter 100 includes outwardly projecting handle portions 103 formed on the end side walls and hanging step portions 104 formed on the lower edges of its lengthwise side walls. A supporter frame 110 includes guide grooves 111 formed on the end side walls to receive/support the handle portions 103, and rectangular holes 112 are formed directly below the guide grooves 111. Therefore, the shaveRunit supporter 100 is mounted in the supporting frame 110, in a manner that each of the handle portions 103 is fitted into one of the guide grooves 111 and each of the hanging step portions 104 is seated on one of the upper edges of the lengthwise side walls of the supporter frame 110. The supporter frame 110 is coupled with the main body 40 with the hook members 42 being inserted in the square holes 112. Rechargeable batteries 120 are loaded in both side spaces of the auxiliary case 20.

Thus, as shown in FIGS. 5A and 5B, the auxiliary case 20 receives the driving motor 30 in a partition 20-2 formed by the intermediate wall 20-2. The motive gear 32 and the follower gears 33 and 33*a* are arranged on the intermediated wall 20-2 to cooperate with each another. It is noted that the motive gears 32 and the follower gears 33 and 33*a* are positioned in the same plane. Also, the auxiliary case 20 stores the batteries 120 in partitions 20-4 formed on both sides of the driving motor partition 20-2. The vibrators 10 are mounted in the upper space formed over the intermediate wall 20-1, in which each of the projections 12 formed on the extending portion of the elastic pieces 11 is inserted into one of the elongated grooves 21 of the guide rails 20-3 to support the vibrators 10 and 10*a*. The eccentric shafts 34 of the follower gears 33 and 33*a* are coupled with respective connecting shafts 13 fixed to the inner side walls of the vibrator 10 by means of the connecting links 35.

The head portion 14 of each vibrator 10 is extended upward through the opening portion 41 of the main body 40 covering the auxiliary case 20 and the through opening 51 of the packing member 50 sealing the opening portion 41. Then the head portion is fixed on the upper surface of the main body 40 together with the pressing member 60 by means of screws. The head portion 14 is U-shaped and forms a cavity therein. The spring 83 is inserted into the cavity between both side walls of the head portion 14. Then, the inner cutter blade structure 80 is coupled with the head portion 14 by means of its cylindrical portion 81, in a manner that the ball-shaped projections 82 are slidably coupled into the elongated holes 15.

The main body 40 permits the supporter frame 110 to be positioned thereon with the hook members 42 hung on respective holes 112. The shave unit supporter 100 is mounted on the main body 40 along with the shave unit frame 90 into which the shave unit 70 is assembled. That is, the handle portions 103 are inserted into respective guide grooves 111 and the step portions 104 are seated on respective lengthwise side walls of the shave unit frame 110.

Figure 1:
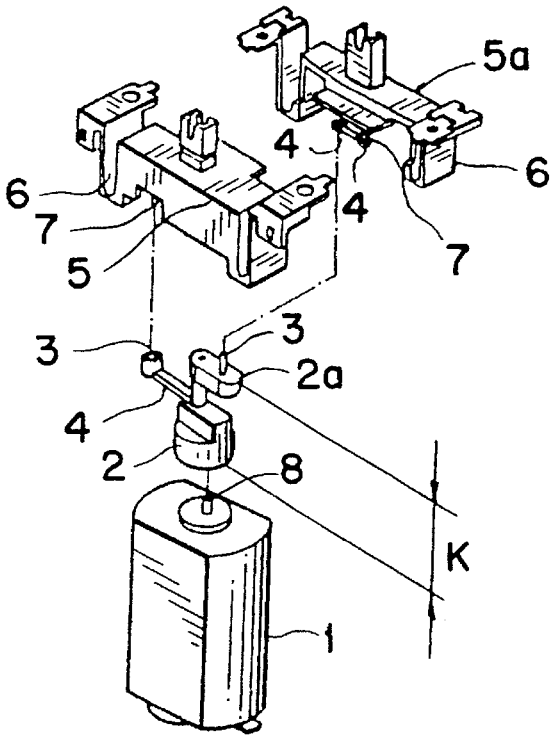
FIG. 1 (PRIOR ART)
FIG. 1 is an exploded perspective view illustrating important elements of a conventional electric shaver.
Figure 2:
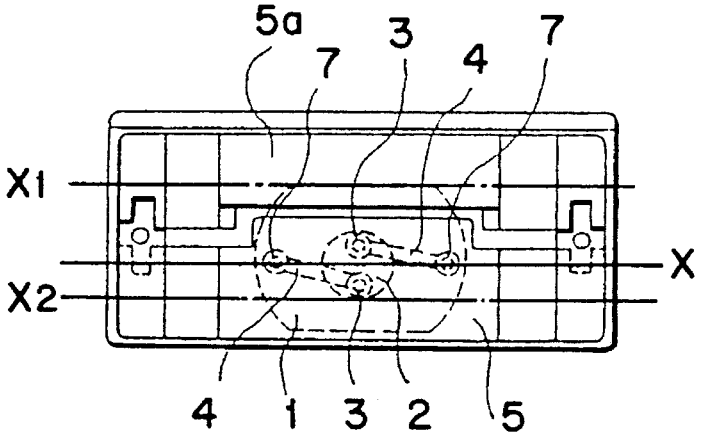
FIG. 2 (PRIOR ART)
FIG. 2 is a plan view illustrating the operation principle of FIG. 1.
Figure 3:
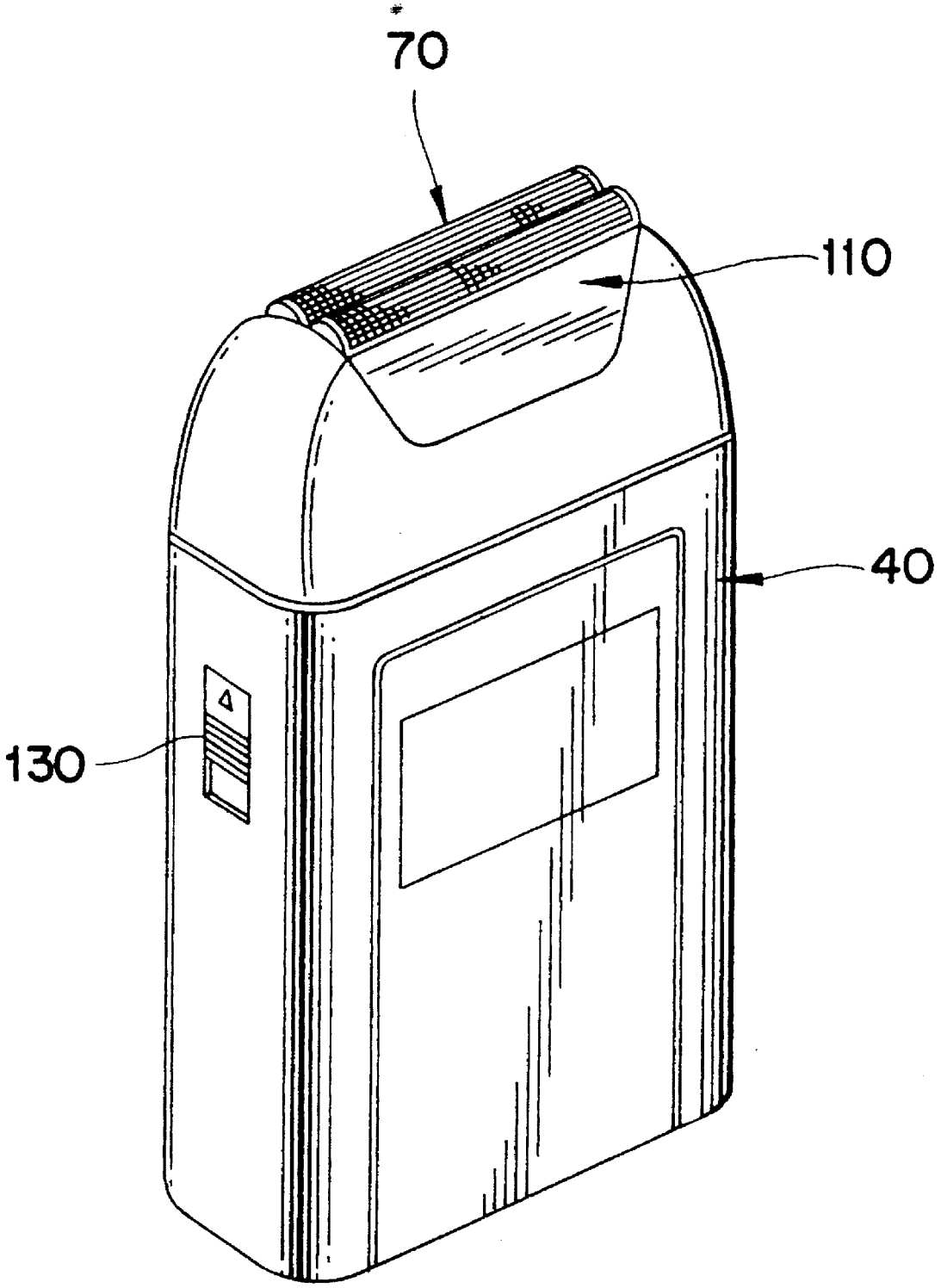
FIG. 3 is a perspective view illustrating the external shape of a reciprocal electric shaver according to the invention.

Therefore, the invention enables the electric energy from the chargeable batteries 120 to be applied to the driving motor 30 according to the on-operation of a switch member 130 (referring to FIG. 3). When the shaver is turned on, the driving motor 30 is operated to rotate the shaft 31. The motor shaft 31 forces the motive force gear 32 and the follower gears 33 and 33*a* to be rotated. The follower gears 33 and 33*a* eccentrically rotate the eccentric shafts 34 fixed thereon. The eccentric rotation causes the elastic pieces 12 connected through the connecting links 35 to the connecting shaft 13 to be expanded or contracted. Thus, the two vibrators 10 and 10*a* are reciprocated in opposite directions to each other, while the inner cutter blade structures 80 mounted on the head portions 14 of the vibrators 10 and 10*a* reciprocate to shave a user's beard through a plurality of apertures 71 of the shave unit 70.

The reciprocating movement of the two vibrators 10 and 10*a* is performed in a reverse phase relationship as shown in FIGS. 6A–6D.

Figure 6A:
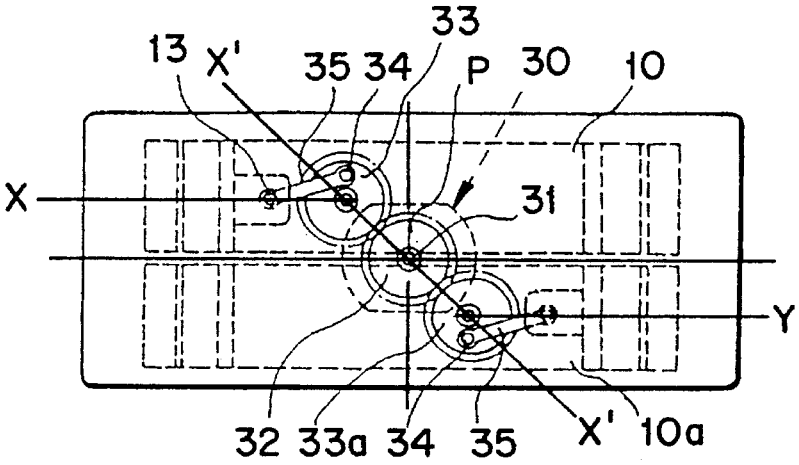

Referring to FIG. 6A, the rotation position of the motive force gear 32 is at the point P of 0° C. The two vibrators 10 and 10*a* are in identical positions, i.e., they are not mutually offset.

Figure 6B:
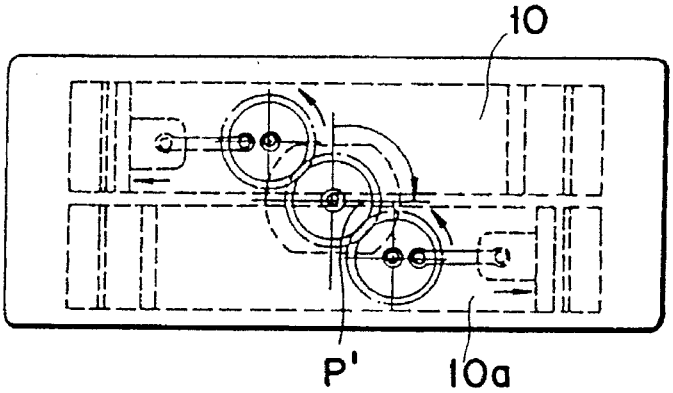

Referring to FIG. 6B, the motive force gear 32 is rotated in a clockwise direction by 90° to the point P'. One follower gear 33 is rotated counterclockwise by gear 32 so that its associated vibrator 10 is moved leftward by an amount equal to the eccentric movement of the eccentric shaft 34. The other follower gear 33*a* is rotated in a counter-clockwise direction by 90° C. so that the other vibrator 10*a* is moved rightward by an amount of the eccentric movement of the eccentric shaft 34. Thus, the two vibrators 10 and 10*a* are moved in a reverse phase relationship to each other to one end of their strokes.

Figure 6C:
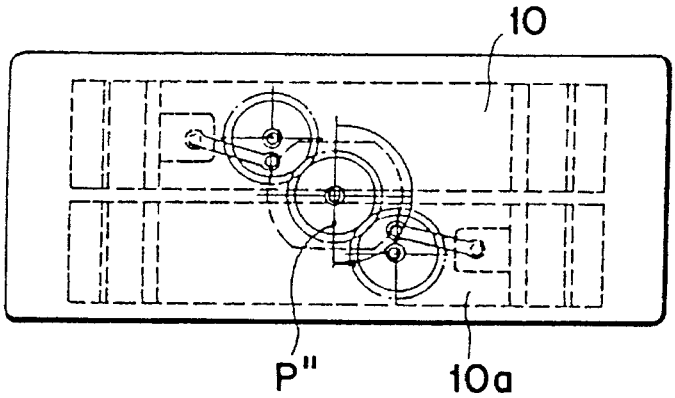

Referring to FIG. 6C, the motive force gear 32 is rotated again by 90° to the point P". The two vibrators 10 and 10*a* are now in the same state shown in FIG. 6A.

Figure 6D:
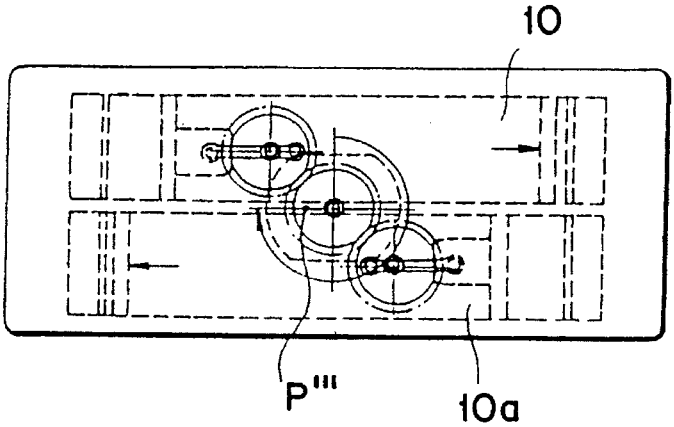

Referring to FIG. 6D, the motive force gear 32 is rotated to the point P'" so one vibrator 10 is moved rightward by an amount of the eccentric movement of the eccentric shaft 34 and the other vibrator 10*a* is moved leftward by an amount of the eccentric movement of the eccentric shaft 34. Thus, the two vibrators 10 and 10*a* are positioned at the state that the eccentric shafts 34 are moved in the reverse phase relationship to each other to the other end of their strokes.

As described above, according to the invention, the rotation movement of the motor shaft is converted into the reciprocating movement, in which the follower gears 33 and 33*a* are arranged in a common plane and are synchronized with the motive force gear 32. Therefore, the length of the motor shaft 31 can be shortened. Also, the vertical load applied to the motor shaft 31 is reduced since no motive force gears or links 35 are mounted thereon, thereby minimizing the vibrations of the motor shafts. Also the operating load of vibrators 10 and 10*a* is reduced because the motive force lies midway between the center lines of the reciprocating movement of the vibrators 10 and 10*a*.

The follower gears 33 and 33*a* can be made by a simple mold, thereby facilitating mass-production and improving quality. The motive force gear 32 and the follower gears 33 and 33*a* can be set at their optional gear ratios, whereby the reciprocation frequency of the vibrators 10 and 10*a* can be altered. The position of the eccentric shaft 34 can be changed to adjust the width and direction of the reciprocation of the vibrators 10 and 10*a*. Furthermore, auxiliary gears synchronized with each of the follower gears 33 and 33*a* can be symmetrically mounted along the center line of the motive force gear 32 and the follower gears 33 and 33*a*.

What is claimed is:

1. A reciprocal electric shaver, comprising a housing;

first and second cutters mounted in said housing for linear reciprocation along parallel paths;

an electric motor mounted in said housing and including a drive shaft rotatable about a main axis; a drive gear affixed to said shaft for rotation therewith;

first and second driven gears mounted for rotation about first and second secondary axes, respectively, oriented parallel to and spaced equidistantly from said main axis, said secondary axes being intersected by a common reference line which also intersects said main axis, both of said driven gears being connected to said drive gear to be driven thereby; and first and second connecting links each interconnecting a respective one of said driven gears and a respective cutter, one end of each of said first and second connecting links being pivotably connected to a respective one of said driven gears for pivotal movement about an eccentric axis oriented parallel to and spaced from said secondary axis of the respective driven gear, said eccentric axes being spaced equidistantly from their respective secondary axes and from said main axis, the other end of said connecting link being pivotally connected to said respective cutter for reciprocating said cutters in mutually opposite directions in response to rotation of said drive gear.

2. The shaver according to claim 1, wherein said driven gears lie in a common plane with said drive gar and are in direct meshing engagement therewith.

3. The shaver according to claim 2, wherein said other ends of said connecting links are spaced equidistantly from said main axis.

4. The shaver according to claim 1, wherein each said cutter includes a center line oriented parallel to said paths of reciprocation and spaced equidistantly from said main axis.

5. The shaver according to claim 4, wherein said secondary axes intersect respective ones of said center lines.

6. The shaver according to claim 1, wherein each said cutter includes opposite ends connected to said housing by elastic elements.

* * * * *